US005540161A

United States Patent [19]

Schroeder, Jr.

[11] Patent Number: 5,540,161

[45] Date of Patent: Jul. 30, 1996

[54] SEWING APPARATUS HAVING A SANDWICH SYNCHRONIZER

[75] Inventor: Roy E. Schroeder, Jr., Elmhurst, Ill.

[73] Assignee: Quick Technologies, Inc., Elmhurst, Ill.

[21] Appl. No.: 521,120

[22] Filed: Aug. 29, 1995

[51] Int. Cl.[6] ..... D05B 69/12

[52] U.S. Cl. ..... 112/220; 112/275

[58] Field of Search ..... 112/220, 275; 341/11, 13, 15; 318/467, 470

[56] References Cited

U.S. PATENT DOCUMENTS

| | | | |
|---|---|---|---|
| 3,683,294 | 8/1972 | Gaa | 112/275 X |
| 5,018,466 | 5/1991 | Hasegawa | 112/275 |
| 5,176,085 | 1/1993 | Hara et al. | 112/275 |

*Primary Examiner*—Peter Nerbun

*Attorney, Agent, or Firm*—Lee, Mann, Smith, McWilliams, Sweeney & Ohlson

[57] ABSTRACT

A sandwich synchronizer for a sewing apparatus. The synchronizer is formed to be interposed between the rotatable drive shaft of a sewing machine and the rotary encoder for the sewing machine. The sandwich synchronizer includes a rotatable synchronizer shaft, an encoder for detecting rotation of the synchronizer shaft, and means at either end of the synchronizer shaft for attaching to the rotary encoder and the rotatable drive shaft. The sandwich synchronizer is a universal synchronizer which can be used in any sewing apparatus, no matter what the manufacturer and no matter what the output of the rotary encoder for that sewing apparatus.

10 Claims, 1 Drawing Sheet

SEWING APPARATUS HAVING A SANDWICH SYNCHRONIZER

BACKGROUND OF THE INVENTION

This invention relates to sewing apparatus, primarily industrial apparatus employing sewing machines, and in particular to a sandwich synchronizer for interposition between a sewing machine and a rotary encoder used by the sewing machine motor to generate a sequence of pulses as the sewing machine is utilized.

In sewing apparatus, and in particular in industrial sewing apparatus, sewing progresses at a high rate of speed. The sewing apparatus is provided with a motor to drive its sewing mechanism, and typically includes a handwheel extending from and comprising part of a rotatable drive shaft of the sewing apparatus. A rotary encoder having an encoder assembly is attached to the drive shaft for generating a series of pulses as the drive shaft is rotated. There are a number of manufacturers of industrial sewing apparatus, and each produces a rotary encoder different from the other. There is no common rotary encoder or common protocol for output from the rotary encoder, and each manufacturer therefore produces a proprietary design having a unique output.

When the rotation of the drive shaft of the sewing apparatus is to be used for other purposes, such as aiding the determination of a skipped stitch, helping in detecting other stitching irregularities, or simply providing the positioning of the sewing head of the sewing apparatus, the output of the rotary encoder must be translated in some manner to be compatible for the intended purpose. If there were a universal means of determining the speed, direction and position of the drive shaft for the sewing apparatus, regardless of the type of motor or manufacturer, that would be a significant improvement from what is presently available.

SUMMARY OF THE INVENTION

The invention is used in a sewing apparatus having a motor for driving means for sewing fabrics and the like. The motor drives a rotatable drive shaft for a sewing machine head, and the apparatus includes a rotary encoder having an encoder assembly attached to the drive shaft for generating a series of pulses as the drive shaft is rotated. In accordance with the invention, a sandwich synchronizer is provided for interposition between the drive shaft and the encoder. The sandwich synchronizer comprises a housing, a rotatable synchronizer shaft mounted in the housing, and means within the housing for detecting rotation of the synchronizer shaft. Means is provided at one end of the synchronizer shaft for attachment to the rotary encoder, and means is provided at the other end of the synchronizer shaft for attachment to the drive shaft.

In accordance with the preferred form of the invention, for attachment to the rotary encoder, an annular disc is secured to the synchronizer shaft. The disc can be removable so that varying sizes can be employed, depending on the size of the rotary encoder being accommodated.

For attachment to the drive shaft of the sewing apparatus, the opposite end of the synchronizer shaft includes an annular cap. At least one set screw is provided in the cap for securing the cap to the drive shaft.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
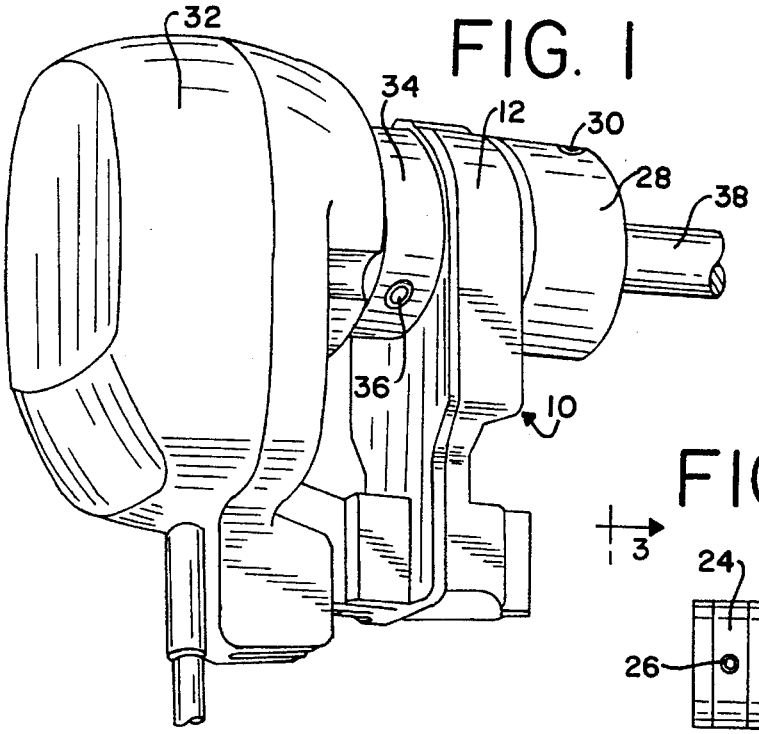
FIG. 1 is a perspective view illustrating a sandwich synchronizer according to the invention, when interposed between a rotary encoder and a drive shaft.
Figure 2:
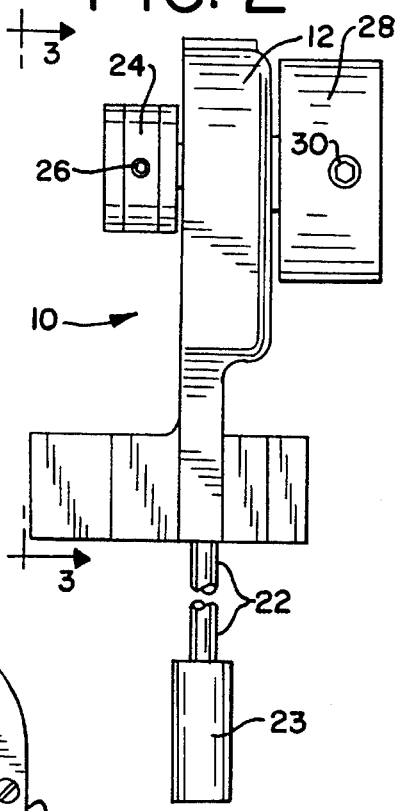
FIG. 2 is an enlarged elevational view of a sandwich synchronizer according to the invention.

A sandwich synchronizer according to the invention is generally illustrated at 10 in the drawing figures. The synchronizer 10 may include conventional encoding elements, and that illustrated in the drawing figures is composed of a housing 12 carrying a shaft 14 mounted in bearings 16. A code disk 18 is secured to the shaft 14, and its rotation is detected within an encoder 20. A connector and cable assembly 22 leads from the encoder 20 to a male connector 23 which can be connected to a computer or other analyzing apparatus (not illustrated).

An annular disc 24 is secured to one end of the shaft 14. One or set screws 26 can be used to secure the disc 24 to the shaft 14. The other end of the shaft 14 includes an integral annular cap 28. The cap 28 also may include one or more set screws 30 for securing the cap to another element.

A typical sewing apparatus, generally for industrial purposes, comprises a sewing machine having a rotary encoder secured to the handwheel of the sewing machine to detect the rotation thereof. The sandwich encoder 10 is intended to be interposed between the handwheel and the rotary encoder. As shown in FIG. 1, a typical rotary encoder 32 is secured to the annular disc 24 by means of a rotary cap 34. One or more spring pins 36 are employed for securely attaching the cap 34 to the disc 24. The rotary encoder 32 may be conventional, and is therefore not described in any greater detail.

Figure 4:
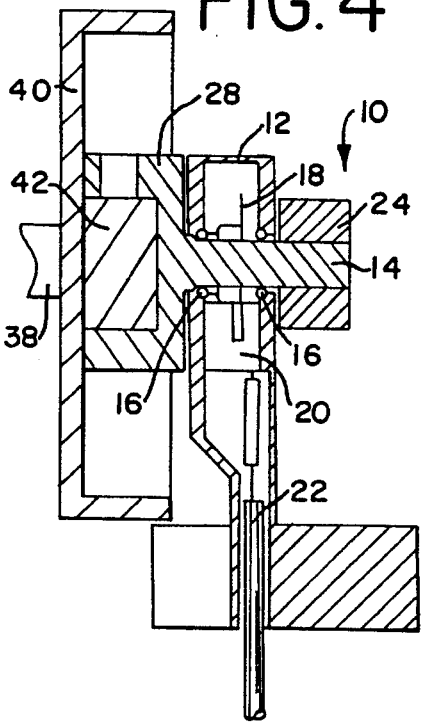
FIG. 4 is a cross-sectional view, taken along lines 4—4 of FIG. 3, and also illustrating, in cross-section, the handwheel of a sewing machine to which the sandwich synchronizer has been attached.
Figure 3:
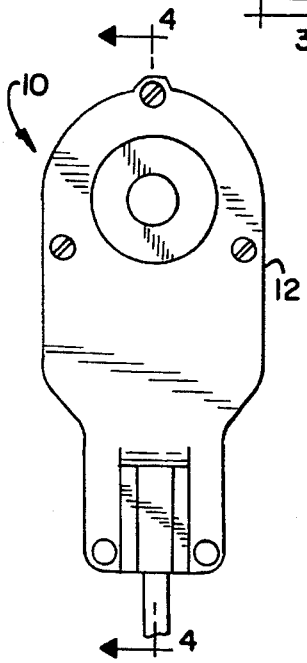
FIG. 3 is a side view thereof, taken along lines 3—3 of FIG. 2.

The cap 28 of the sandwich synchronizer 10 is secured to a handwheel for the sewing apparatus. FIG. 1 illustrates a drive shaft 38 for the sewing machine head secured in the cap 28, with the typical handwheel for the sewing apparatus being omitted for purposes of clarity. However, the handwheel, designated 40, is illustrated in FIG. 4. As shown in that figure, the cap 28 is secured to a circular protrusion 42 of the handwheel 40, with the shaft 38 extending centrally from the handwheel 40.

In use, the sandwich synchronizer 10 is installed between the rotary encoder 32 and the handwheel 40. In the typical sewing apparatus, the encoder 32 is secured by means of its cap 34 to the protrusion 42 of the handwheel 40. The cap 34 is therefore separated from the protrusion 42, and the sandwich synchronizer 10 is then installed inbetween, with its cap 28 secured to the protrusion 42 and the cap 34 of the rotary encoder 32 being secured to the disc 24 of the synchronizer 10. Thus, the synchronizer 10 is sandwiched between the sewing apparatus on the one hand, and the rotary encoder 32 for that sewing apparatus. No matter what the nature of the sewing apparatus may be, and no matter what the output of the rotary encoder 32 may be, by interposing the sandwich synchronizer 10 in the position illustrated, rotary output from the sewing apparatus, as determined by the sandwich synchronizer 10, can be universally utilized for whatever purpose may be necessary, including providing clock pulses for determining skipped stitches, pulses for determining other irregularities in the sewing process, or for simply instantaneously providing positional information for the shaft of the sewing apparatus.

Various changes can be made to the invention without departing from the spirit thereof. For example, the housing 12 of the sandwich synchronizer 10 can be configured as desired so that when it is interposed between the sewing machine of a sewing apparatus and the rotary encoder for that apparatus, it is held firmly in place and prevented from rotating. Various other changes can be made to the invention without departing from the spirit thereof or scope of the following claims.

What is claimed is:

1. In a sewing apparatus having a motor for driving means for sewing fabrics and the like, the motor being connected for driving a sewing head having a rotatable drive shaft and the apparatus including a rotary encoder having an encoder assembly attached to the drive shaft for generating a series of pulses as the drive shaft is rotated, a sandwich synchronizer for interposition between the drive shaft and the encoder, said synchronizer comprising a. a housing, b. a rotatable synchronizer shaft mounted in said housing, c. means within said housing for detecting rotation of said synchronizer shaft, d. means at one end of said synchronizer shaft for attachment to said rotary encoder, and e. means at the other end of said synchronizer shaft for attachment to said drive shaft.

2. A sandwich synchronizer according to claim 1 in which said means at one end comprises an annular disc secured to said synchronizer shaft.

3. A sandwich synchronizer according to claim 2 in which said disc is removable.

4. A sandwich synchronizer according to claim 1 in which said means at the other end comprises an annular cap.

5. A sandwich synchronizer according to claim 4 including at least one set screw in said cap for securing said cap to said drive shaft.

6. A sewing apparatus, comprising a. a sewing machine having a handwheel, said handwheel comprising part of a rotatable drive shaft of the sewing machine, b. a rotary encoder having an encoder assembly formed to be attached to said handwheel, and c. a sandwich synchronizer interposed between said handwheel and said encoder, said synchronizer comprising i. a rotatable synchronizer shaft, ii. means for detecting rotation of said synchronizer shaft, iii. means at one end of said synchronizer shaft for attachment to said rotary encoder, and iv. means at the other end of said synchronizer shaft for attachment to said handwheel.

7. A sewing apparatus according to claim 6 in which said means at one end comprises an annular disc secured to said synchronizer shaft.

8. A sewing apparatus according to claim 7 in which said disc is removable.

9. A sewing apparatus according to claim 6 in which said means at the other end comprises an annular cap.

10. A sewing apparatus according to claim 9 including at least one set screw in said cap for securing said cap to said handwheel.

* * * * *